United States Patent [19]

Sung

[11] Patent Number: 4,699,378

[45] Date of Patent: Oct. 13, 1987

[54] TENNIS BALL THROWING MACHINE

[75] Inventor: Lan C. Sung, Taichung, Taiwan

[73] Assignee: David T. Chu, Taichung, Taiwan

[21] Appl. No.: 884,032

[22] Filed: Jul. 10, 1986

[51] Int. Cl.[4] ..... A63B 69/40

[52] U.S. Cl. ..... 273/29 A; 124/7; 124/41 R

[58] Field of Search ..... 273/26 D, 29 A; 124/41 R, 81, 7, 6

[56] References Cited

U.S. PATENT DOCUMENTS

| | | | |
|---|---|---|---|
| 3,207,147 | 9/1965 | Giovagnoil | 124/7 |
| 3,252,453 | 5/1966 | Giovagnoil | 124/7 |
| 3,601,111 | 8/1971 | Embry | 124/7 |
| 4,325,351 | 4/1982 | Yuasa | 124/81 |
| 4,570,607 | 2/1986 | Stokes | 124/81 |
| 4,615,325 | 10/1986 | Yamamura | 124/7 |

*Primary Examiner*—Richard C. Pinkham
*Assistant Examiner*—T. Brown
*Attorney, Agent, or Firm*—Holman & Stern

[57] ABSTRACT

A tennis ball throwing machine which comprises a motor secured to a frame board, the output end of the motor shaft having a gear wheel securely mounted thereon, first and second transmission shaft respectively fixed to a gear wheel at one end thereof and engaged with the gear wheel of the motor, a bat pivotally attached to the first transmission shaft, one end of the bat being a hitting portion, and the other end thereof being attached to a tension spring, a cam pivoted on the second transmission shaft, a ball guiding groove being pivoted on a supporting shaft and having a portion thereof in contact with the cam to move upward, downward, leftward and rightward, a tension spring at the bottom end of the ball guide groove. The axis of the cam which is eccentric with and at an angle relative to the second transmission shaft, and two guiding boards are provided beneath the ball guiding groove, the two guiding boards being clamped on both sides of the cam whereby the ball guiding groove driven by the cam may move upward, downward, leftward and rightward to change the throwing direction.

4 Claims, 6 Drawing Figures

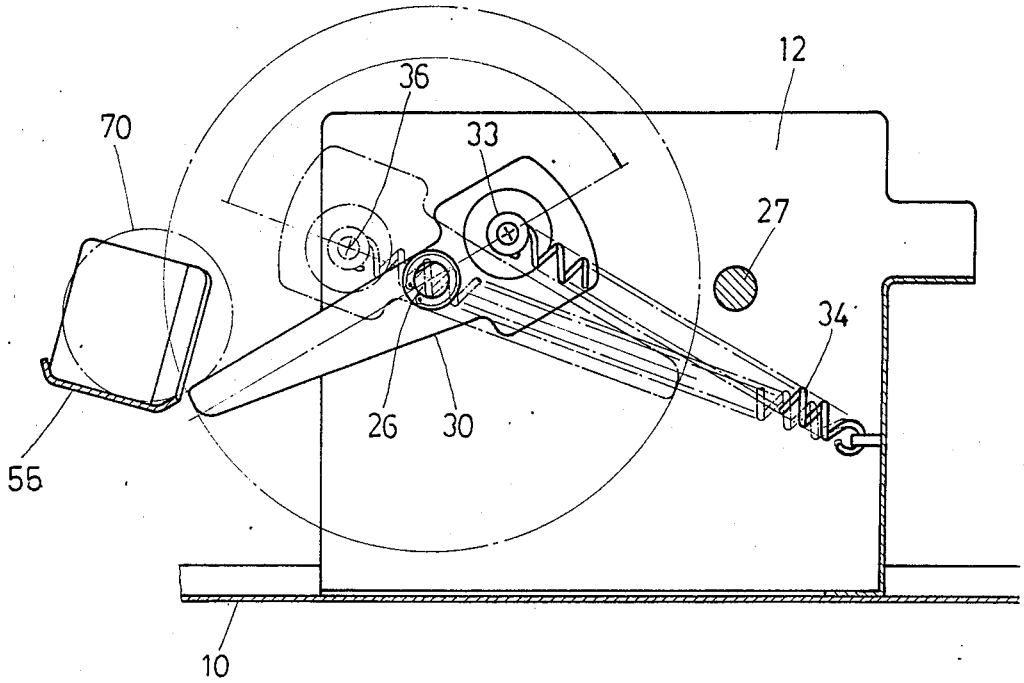
F I G. 3 A-A SECTION
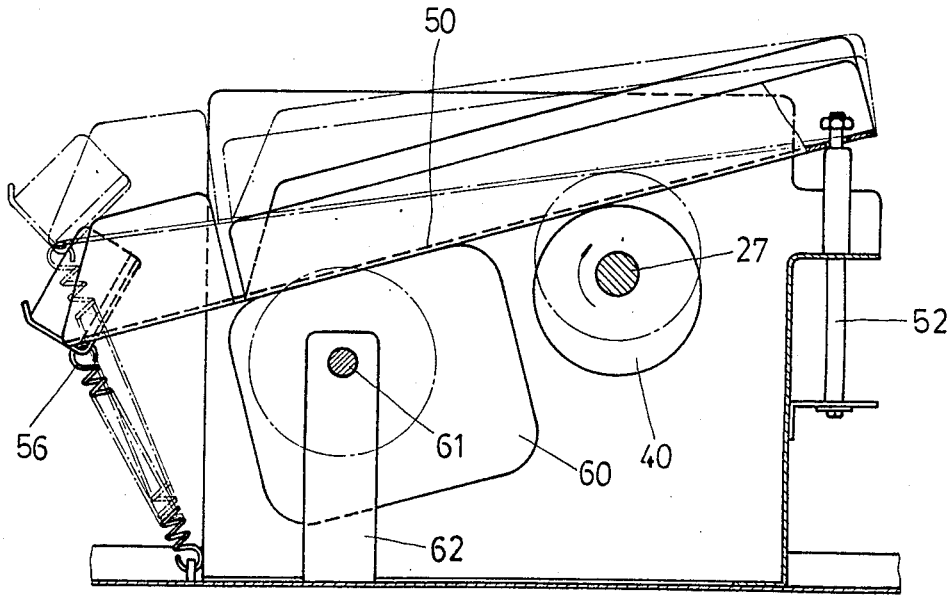
F I G. 4 B-B SECTION

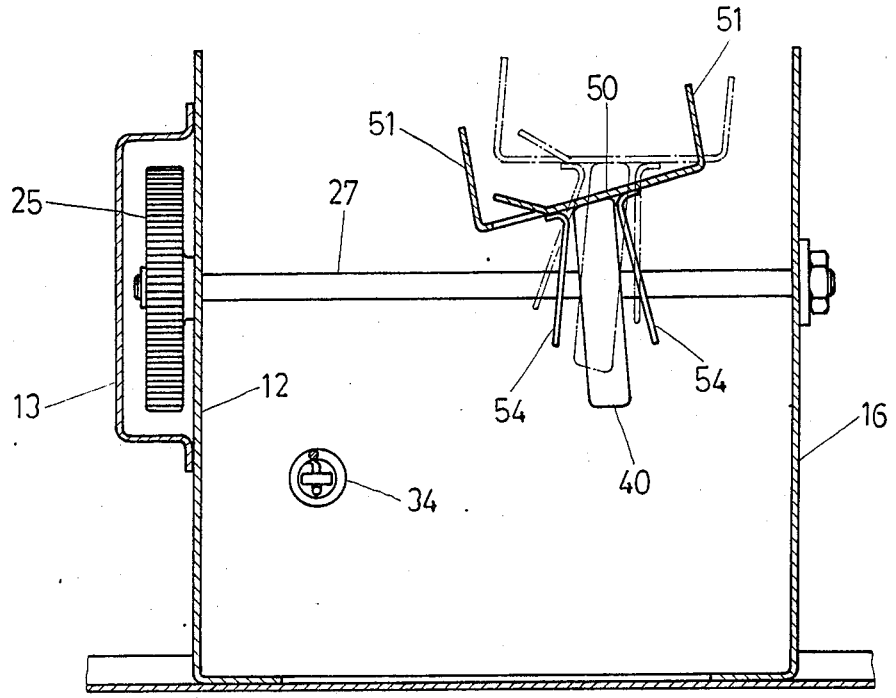
F I G. 5 C-C SECTION
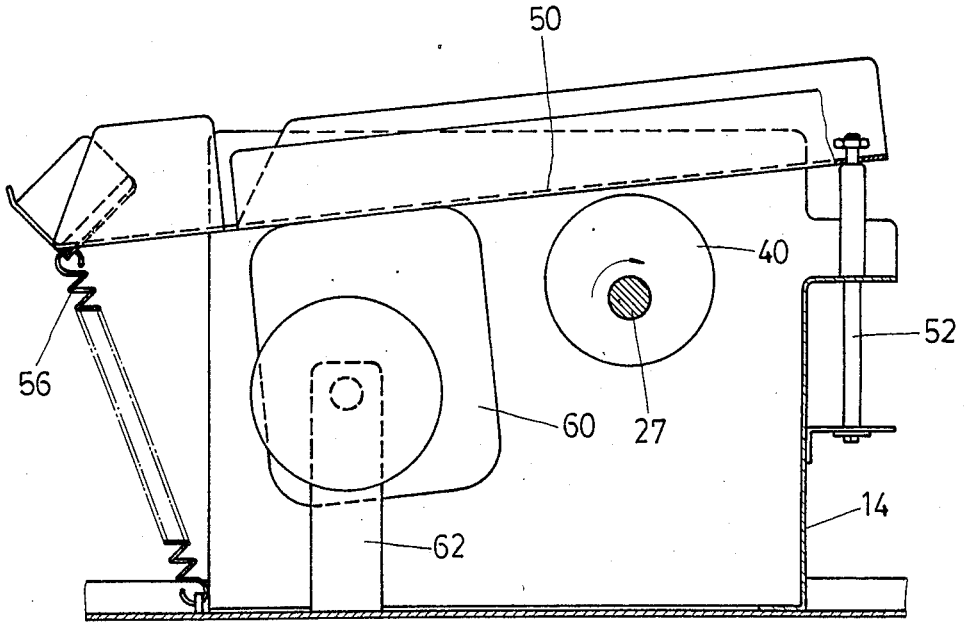
F I G. 6 B-B SECTION

TENNIS BALL THROWING MACHINE

BACKGROUND OF THIS INVENTION

This invention relates to a tennis ball throwing machine, more particularly to one which makes improvement to actuating means for the tennis ball guiding chute.

There is a throwing machine of air compression type applying an air compressor actuated by motor to produce highly compressed air into the throwing tube. When the air pressure is greater than the friction force between tennis ball and the wall of throwing tube, the tennis ball shoots from the throwing tube as does the bullet from the air compressed pistol. However, the throwing machine of air compression type being great in volume, high in manufacturing cost and needing more power is usually suitable for formal tennis training course.

Recently, there was developed a small tennis ball throwing machine provided for family or small tennis court use. Such a small tennis ball throwing machine applies transmission gear actuated by a motor to change speed and make two bats rotate, and a spring to store pressure whereby the bats increase the tennis ball hitting speed. The known tennis ball throwing machines are generally similar in transmission means, however different from one another in means to change the direction of tennis ball throwing on which the effectiveness thereof depends entirely.

One object of this invention is to provide a tennis ball throwing machine which may change in a great variety the tennis ball throwing direction whereby the tennis ball throwing direction is different each time for the user to practice every kind of tennis ball serving direction and reaction.

Another object of this invention is to provide a tennis ball throwing machine which is simple in structure, low in manufacturing cost and convenient in carrying.

A tennis ball throwing machine according to this invention comprises a power supply transmission means which comprises a motor mounted on a frame board, the motor shaft thereof transmitting through a gear wheel the power to a first and second transmission shaft parallel to each other, a bat pivoted on the first transmission shaft, one end of the bat being a hitting portion in a suitable length, the other end thereof being provided with a pivot shaft to pull a tension spring one end of which is secured on the frame board, a cam pivoted on the second transmission shaft, a ball guiding chute made of a long plate with both longitudnal sides bent upward, one end of the ball guiding chute being pivoted on a supporting shaft as a result of which the ball guiding chute may move upward, downward, leftward and rightward, the other end of the ball guiding chute sloping downward to form a bent holding portion at the bottom, and a a tension spring the bottom end of which is in contact with the surface of the cam, characterized in that the axis of the cam which is biased and the second transmission shaft form a sloping angle, and two guiding boards are provided beneath the ball guiding course, the two guiding boards being clamped on both sides of the cam whereby the ball guiding chute driven by the cam may move upward, downward, leftward and rightward to change the throwing direction.

The other characteristics of this invention is that between the holding portion beneath the bottom end of the ball guiding chute and the cam a polygonal eccentric solid is further provided and a shaft of an adjustment button is secured on the eccentric portion at each opposite sides of the polyglnal eccentric solid so that by means of the adjustment button the ball guiding chute may be biased at different heights and when the ball guiding chute is biased at the highest position, the cam in rotation cannot touch the bottom surface of the ball guiding chute where the ball guiding chute maintains at a stable position to keep the throwing direction regular.

BRIEF DESCRIPTION OF THE DRAWINGS OF THE PREFERRED EMBODIMENTS OF THIS INVENTION

FIG. 3 is a side view along A—A line of FIG. 2, the dotted lines showing how the tennis ball is hit;

FIG. 4 is a side view along B—B line of FIG. 2 showing how a ball guiding chute is pushed upward and downward by a cam;

FIG. 5 is a side view along C—C line of FIG. 2 showing how a ball guiding chute is pushed leftward and rightward by a cam;

FIG. 6 is a side view along B—B line of FIG. 2 showing how a ball guiding chute is moved to a highest position to depart from a cam by a biased solid.

DETAILED DESCRIPTION OF THE PREFERRED EMBODIMENTS OF THIS INVENTION

Figure 1:
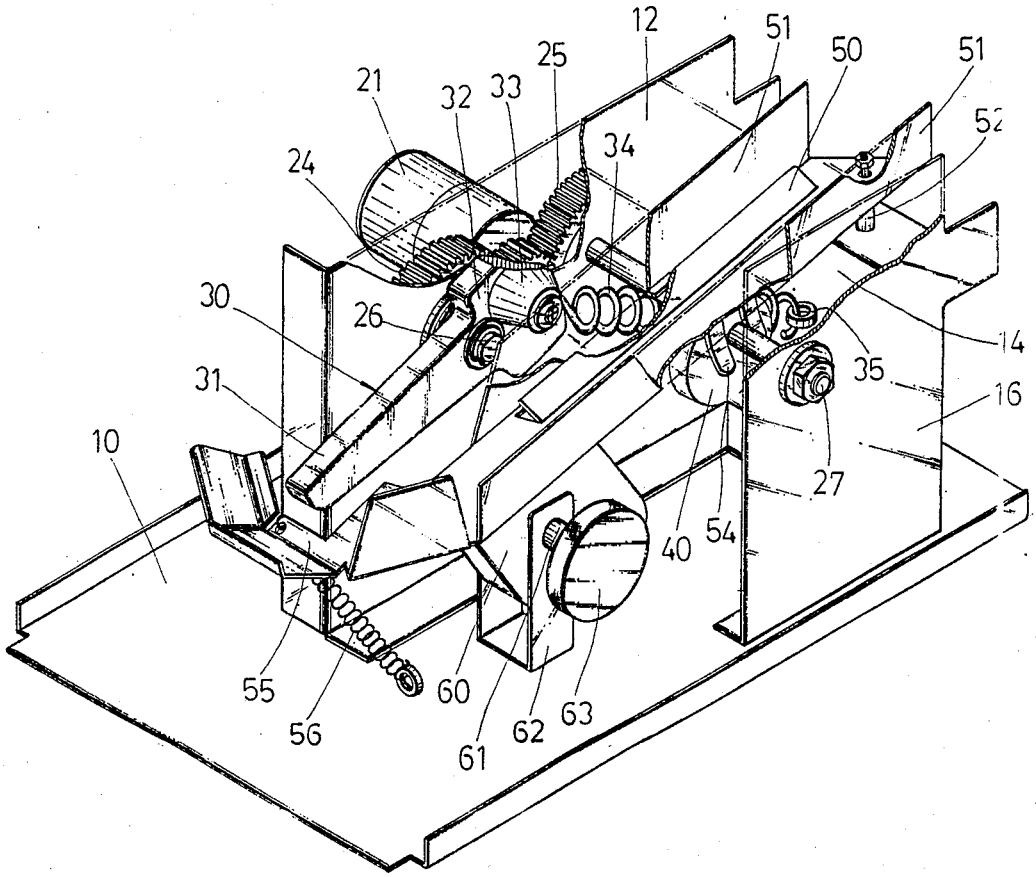
FIG. 1 is a perspective view of a preferred embodiment of this invention the upper portion of which is partially taken away to better show the structure thereof.
Figure 2:
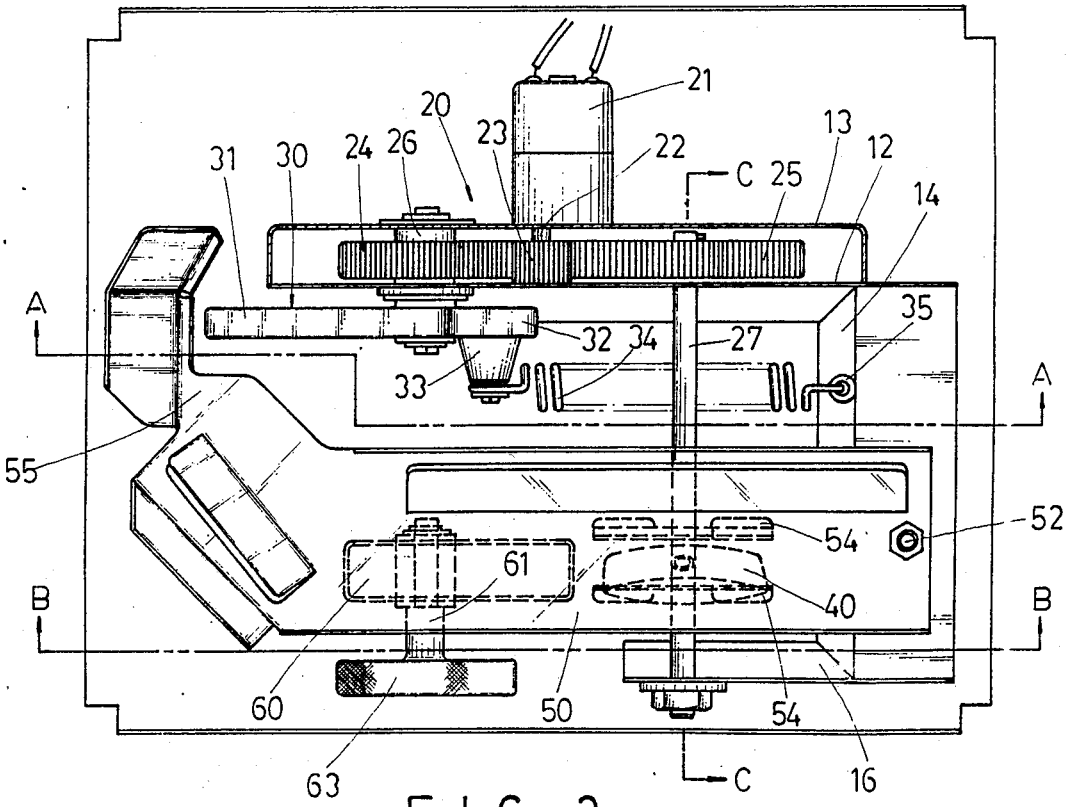
FIG. 2 is a top view of FIG. 1.

As shown in FIGS. 1 & 2, a tennis ball throwing machine comprises a base board 10 on which perpendicular frame boards 12, 14 & 16 bent in shape are securedly mounted. Respectively on the frame boards a power supply transmission means 20, a bat 30, a cam 40, a ball guiding chute or groove 50 and a rectangular eccentric adjustment solid 60 are mounted. Details of the above disclosed devices will be described as follows.

The power supply transmission means 20 comprises a motor 21 which is securedy mounted on the frame board 12 and a frame board 13 both being parallel to each other. The motor 21 has a motor shaft 22 on the end of which a gear wheel 23 is provided. The gear wheel 23 engages with the other gear wheels 24 & 25, a first transmission shaft 26 on which the gear wheel 24 is mounted is rotably supported on the frame boards 12 & 13 at one end and secured a bat 30 at the other end. A second transmission shaft 27 on which the gear wheel 25 is mounted is rotably supported on the frame boards 12 & 16.

The bat 30 which is secured on the first transmission shaft 26 has at one end a portion in suitable length to form a hitting portion 31 and is provided with a heavy balancing solid 32 to balance of the weight of the hitting portion 31. A pivot 33 is provided on one side of the heavy balancing solid 32. A tension spring 34 is mounted with one end on the pivot 33 and secured with the other end on a stationary ring 35 mounted fixedly on the frame board 14.

The cam 40 approximately in disc shape is eccentric. And, the cam 40 is secured on the second transmission shaft 27 in such a way that the axis of the cam 40 and the second transmission shaft 27 form an inclined angle.

When the second tranmission shaft 27 rotates, the circumference of the cam 40 moves upward, downward, leftward and rightward.

The ball guiding groove 50 is made of a long plate respectively having a bent portion 51 on both longitudinal sides thereof to guide the falling balls. The ball guiding groove 50 is pivoted on the top of a supporting shaft 52 so that the ball guiding groove 50 may take the supporting shaft 52 as a fulcrum to move upward, downward, leftward and rightward. The other end of the ball guiding groove 50 slopes downward. The bottom surface of the ball guiding groove 50 is in contact with the cam 40 and at the bottom surface of the ball guiding groove 50 there are provided with two guiding boards 54 which respectively locate next to both sides of the cam 40. The bottom surface of the ball guiding groove 50 is bent to form a holding portion at the bottom surface of which there is secured a tension spring 56.

The quadrilateral eccentric adjustment solid or cam 60 locates between the tension spring 56 and cam 40 beneath the ball guiding groove 50. The quadrilateral biased eccentric solid 60 is eccentricaly pivoted with a shaft 61 on a supporting frame 62. The rotation of the shaft 61 and the eccentric adjustment solid 60 may be controlled by an adjustment button 63. The eccentric adjustment solid 60 is polygonal and the distance from the axis of the shaft 61 to each point of the circumference of the eccentric adjustment solid is different whereby the polygonal eccentric solid 60 may be adjustment at different position.

How the throwing machine according to the above disclosed preferred embodiments of this invention operates is explained as follows.

As shown in FIGS. 1, 2 & 3, in operation, the tennis balls fall within the ball guiding groove 50 due to gravity.

The tennis ball at the lowest position is held at the holding portion 55. The motor 21 transmits power through the gear wheels 23 & 24 to rotate the first transmission shaft 26 and then rotate the bat 30. The pivot 33 at the side of the heavy balancing solid 32 at one end of the bat 30 will pull the tension spring 34 during rotation to store force, the tension spring 34, when the pivot 33 passes over the pulling dead point 36, will pull the pivot 33 to speed up rotation as a result of which the hitting portion 31 of the bat 30 increases the speed to hit the tennis ball from the holding portion 55. The ball hitting motion continues till the motor 21 stops. This ball hitting motion as disclosed is the same as the prior art.

As shown in FIGS. 4 & 5, the motor 21 rotates to actuate the hitting portion 30 and the second transmission shaft 27 as a result of which the cam 40 rotates. The cam 40 which is eccentric will cooperate with the tension spring 56 to push the ball guiding groove 50 to move upward and downward (as shown in FIG. 4). The cam 40 which is secured on the second transmission shaft 27 in an axially incline way will push the guiding boards 54 to move leftward and rightward during rotation, ie; push the ball guiding chute 50 to move leftward and rightward (as shown in FIG. 5). The ball guiding groove 50 during hitting ball is subject to the push of the cam 40 to move upward, downward, leftward and eightward so as to change the angle and direction of the tennis ball at the holding portion 55 in relation to the bat 30. As a result thereof, the ball hitting direction is different each time. This is one of the key characteristics of this invention.

Further as shown in FIGS. 4 & 6, the throwing machine according to this invention changes the throwing direction by means of the cam 40 and further rotates the quadrilateral eccentric adjustment solid 60 by means of the adjustment buttom 63 to adjust the ball guiding groove at different heights as a result of which the cam 40 will be in contact with the ball guiding groove 50 intermittently. Thus, the throwing machine will throw some kind of ball within some direction to increase the variety of ball throwing. As shown in FIG. 6, when the quadrilateral eccentric adjustment solid 60 rotates to a position where the ball guiding groove 50 is biased to the highest position, the cam 40 in rotation does not contact with the bottom surface of the ball guiding groove 50, i.e., the ball guiding groove 50 maintains at stationary position as a result of which the bat 30 will hit tennis ball in a regular direction for the trainee to practice the ball in a regular direction. This is another one of the characteristics of this invention.

In summary, the tennis ball throwing machine according to this invention improves on the cam 40 and the polygonal eccentric adjustment solid 60 whereby the throwing direction of the throwing machine is continually changed in variety and alternative in choosing the desired direction of tennis ball throwing.

What I claim is:

1. In a ball throwing machine having a rotary bat, a motor, and a first drive means between the motor and the bat for continuously rotating the bat so as to sequentially project balls from the machine with successive rotations of the bat, the improvement comprising guide means for continuously changing the direction in which the balls are thrown from the machine, the guide means including an inclined ball-receiving guide chute having an upper end and a lower end, pivot means supporting the upper end of the chute for up and down as well as side to side pivotal movement of the chute about the pivot means, the lower end of the chute being formed as a ball-retention member for locating balls in position to be projected from the mechanism by the bat, the guide means further including a second drive means connected between the motor and the chute for continuously changing the angle of the chute relative to the bat by continuously pivoting the chute in up and down as well as side to side movements about the pivot means, the second drive means comprising an eccentric cam element rotated by the motor means, the cam element peripherally engaging the chute to impose one of said up and down and side to side movements on the chute, the cam means further being mounted on a drive shaft at an incline and engaging follower means carried by the chute to impose the other of said up and down and side to side movements on the chute.

2. The improvement of claim 1 wherein the cam element is positioned peripherally to engage an undersurface of the chute for imposing the up and down movements on the chute, the mechanism including spring means urging the chute into engagement with the cam element, and wherein the follower means comprises a pair of plates extending below the chute and straddling the cam element.

3. The improvement of claim 2 wherein the machine further includes a rotatable manually adjustable geometric cam member engaging an undersurface of the chute for establishing a minimum angle for the chute relative to the horizontal dependent on the rotational postion of the cam member.

4. The improvement of claim 3 wherein the cam member has a rotational position in which it maintains the undersurface of the chute out of engagement with the periphery of the cam element.

* * * * *